US007849623B1

(12) United States Patent
Woller et al.

(10) Patent No.: US 7,849,623 B1
(45) Date of Patent: Dec. 14, 2010

(54) MUZZLELOADING RIFLE WITH ROLLING BLOCK TRIGGER ASSEMBLY

(75) Inventors: Ronald Woller, Decatur, AL (US); Douglas Thornburg, Muscle Shoals, AL (US); Aaron Simms, Hartselle, AL (US)

(73) Assignee: P.I. Inc., Athens, TN (US)

( * ) Notice: Subject to any disclaimer, the term of this patent is extended or adjusted under 35 U.S.C. 154(b) by 459 days.

(21) Appl. No.: 11/962,472

(22) Filed: Dec. 21, 2007

Related U.S. Application Data

(60) Provisional application No. 60/988,645, filed on Nov. 16, 2007.

(51) Int. Cl.
*F41C 7/00* (2006.01)

(52) U.S. Cl. ..... 42/51; 89/1.3; 42/28; 42/34; 42/38

(58) Field of Classification Search ..... 42/51, 42/9, 28, 30, 34, 38; 89/1.3
See application file for complete search history.

(56) References Cited

U.S. PATENT DOCUMENTS

| | | | | | |
|---|---|---|---|---|---|
| 2,447,891 | A * | 8/1948 | Arrowsmith | ..... | 42/34 |
| 2,627,687 | A * | 2/1953 | Arbuckle | ..... | 42/34 |
| 2,962,016 | A * | 11/1960 | Ryan | ..... | 124/2 |
| 3,165,850 | A * | 1/1965 | Orozco | ..... | 42/34 |
| 4,700,499 | A | 10/1987 | Knight | | |
| 5,915,934 | A | 6/1999 | Knight et al. | | |
| 6,360,467 | B1 | 3/2002 | Knight | | |
| 6,604,311 | B1 * | 8/2003 | Laney et al. | ..... | 42/51 |
| 7,065,913 | B2 * | 6/2006 | Lizarralde et al. | ..... | 42/51 |
| 7,076,902 | B2 * | 7/2006 | Hengstenberg et al. | ..... | 42/51 |
| 7,257,917 | B1 | 8/2007 | Garland | | |

* cited by examiner

*Primary Examiner*—J. Woodrow Eldred
*Assistant Examiner*—Gabriel J Klein
(74) *Attorney, Agent, or Firm*—Mark J. Nahnsen; Barnes & Thornburg LLP

(57) ABSTRACT

A muzzleloading firearm for engaging a firing pin to discharge a primer includes a trigger plate connected between a front stock and a rear stock, with a central cavity traversing the trigger plate to support a sear and a trigger in mechanical communication with the sear. A hammer assembly is pivotally mounted to the trigger plate to rotate between a cocked position and a resting position, and includes a base extending into the central cavity. The base includes an upper arcuate surface opposite a lower locking surface having a shoulder. A hammer head member is connected to the upper arcuate surface to engage a firing pin. A rolling breechblock is pivotally attached to the plate between a retracted loading position and a firing position, and has a curved upper surface to engage the arcuate surface of the hammer assembly when moving between the loading position and the firing position to force the distal end of the sear to engage shoulder of the base. The firearm also includes a hammer safety pivotally connected to the hammer head member to move between a hammer firing position engaging the firing pin and a hammer safety position engaging the rolling breechblock.

5 Claims, 21 Drawing Sheets

MUZZLELOADING RIFLE WITH ROLLING BLOCK TRIGGER ASSEMBLY

CROSS REFERENCE TO RELATED PATENT APPLICATIONS

This non-provisional patent application claims priority from provisional patent application 60/988,645, filed on Nov. 16, 2007, which is relied upon and incorporated herein by reference.

FIELD OF THE INVENTION

This application relates generally to a muzzleloading rifle having an improved trigger assembly.

BACKGROUND

A rolling block is a form of firearm action where the sealing of the breech is done with a specially shaped breechblock able to rotate on a pin. The breechblock is shaped like a section of a circle. The breechblock is locked into place by the hammer, thus preventing the primer from moving backwards at the moment of firing. By cocking the hammer, the breechblock can be rotated freely to reload the firearm.

DETAILED DESCRIPTION OF THE INVENTION

Figure 1:
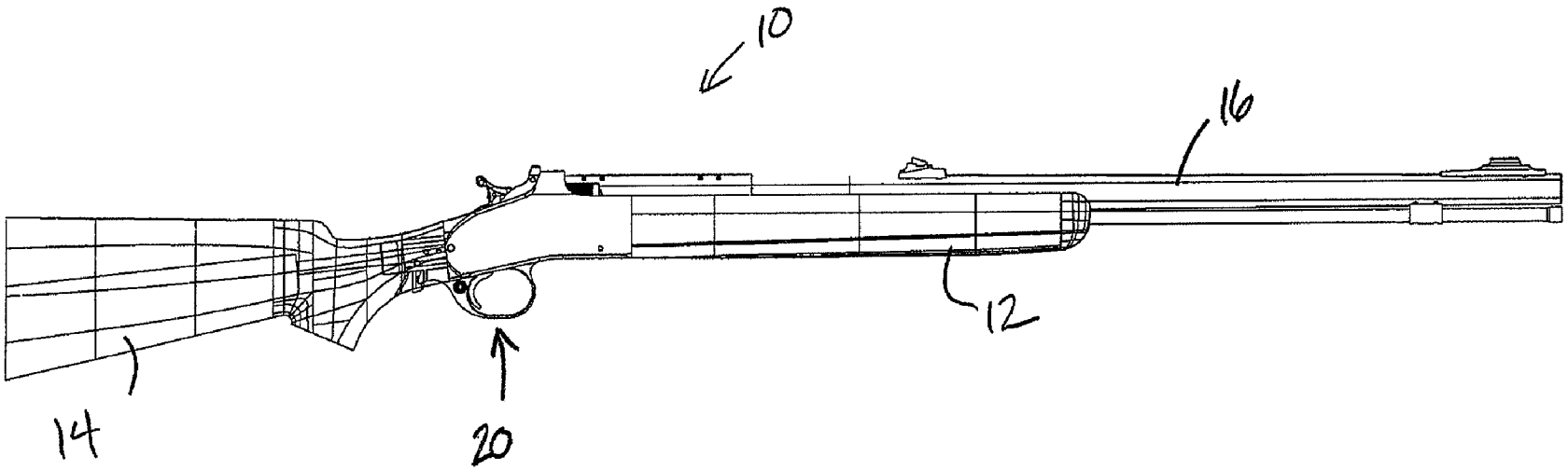
FIG. 1 is a side elevational view of a firearm.
Figure 2:
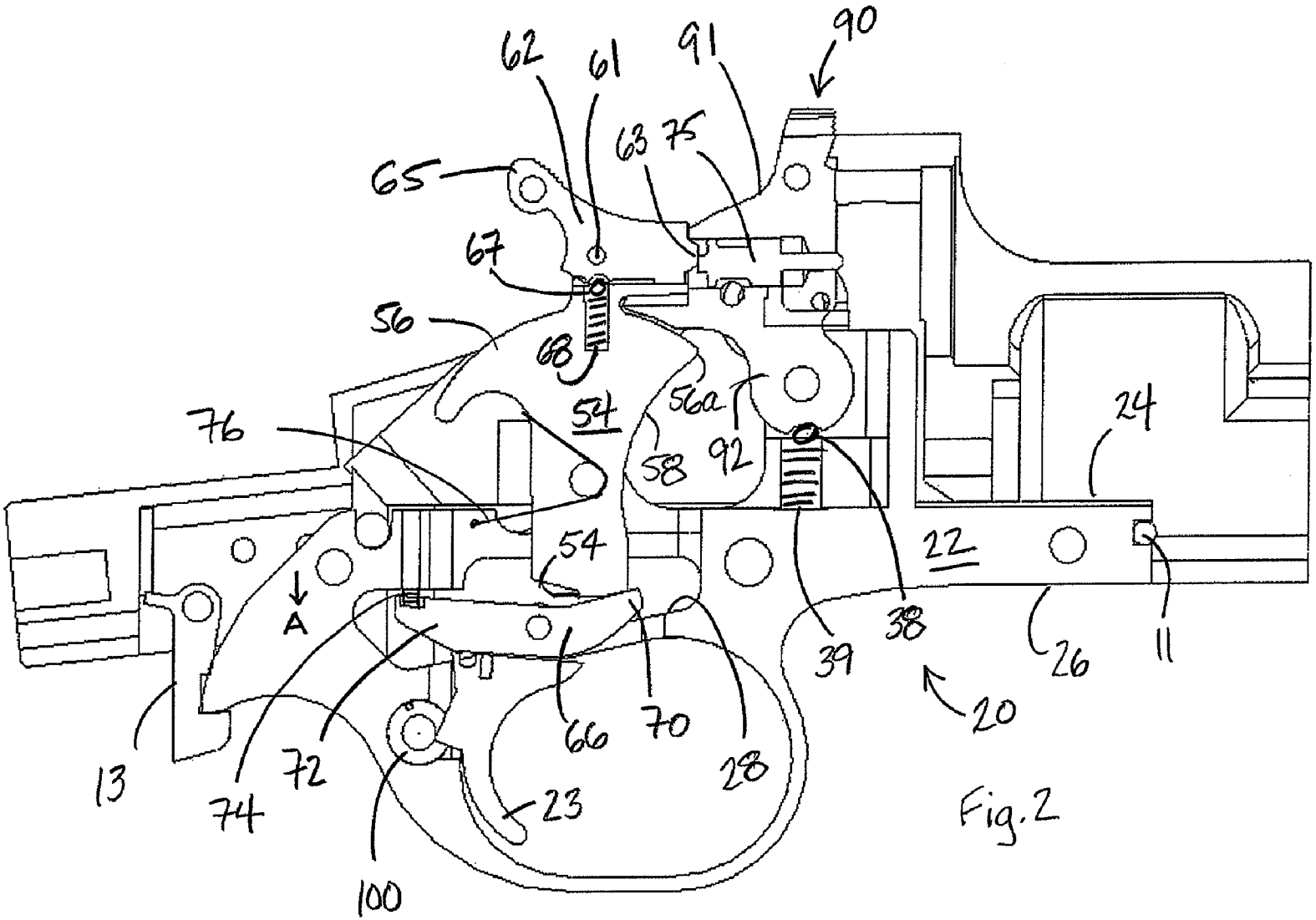
FIGS. 2-6 are side elevational views of the trigger assembly of the firearm illustrated in FIG. 1, with a portion of the trigger assembly removed to view a hammer assembly.
Figure 3:
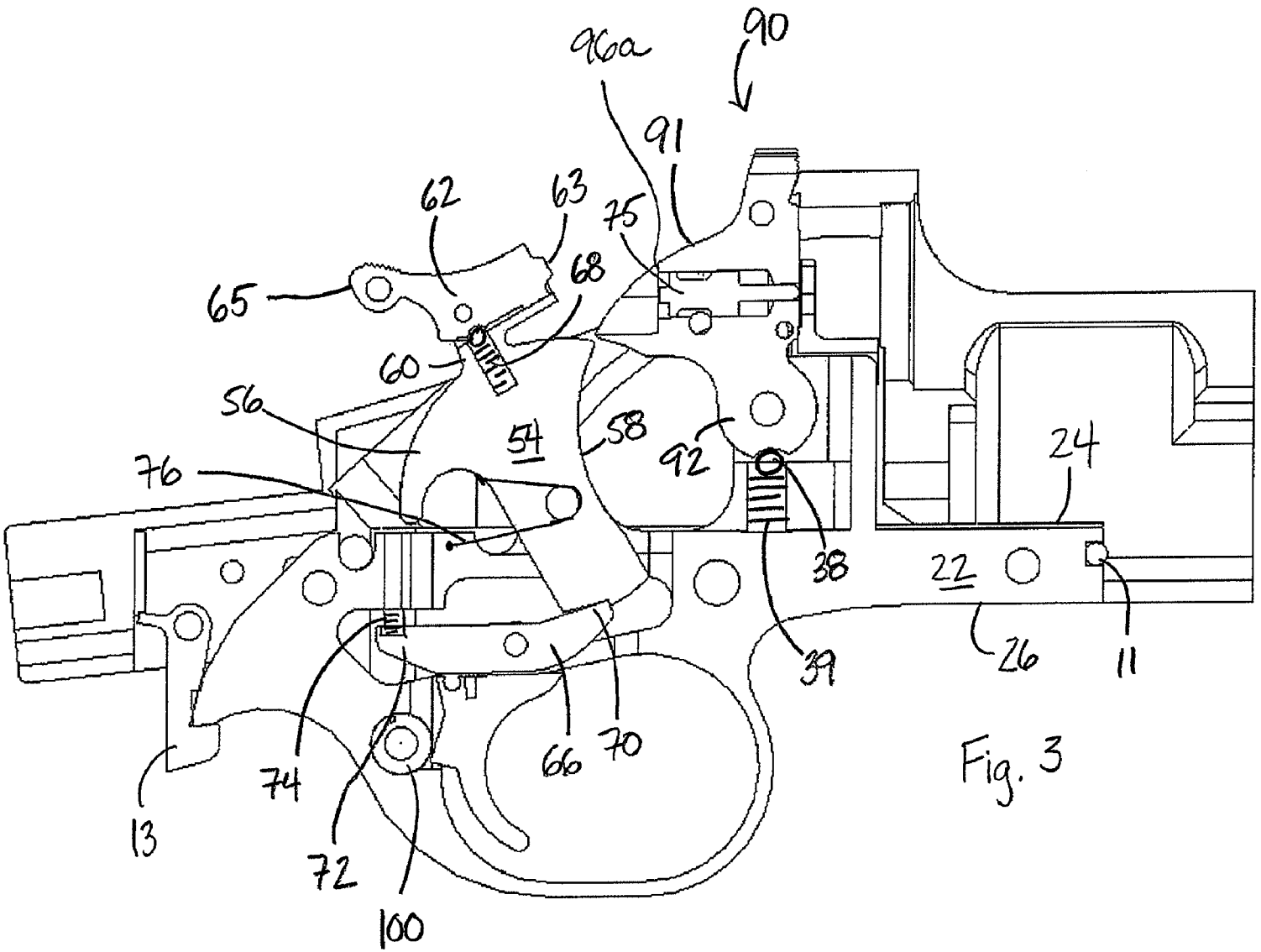
Figure 4:
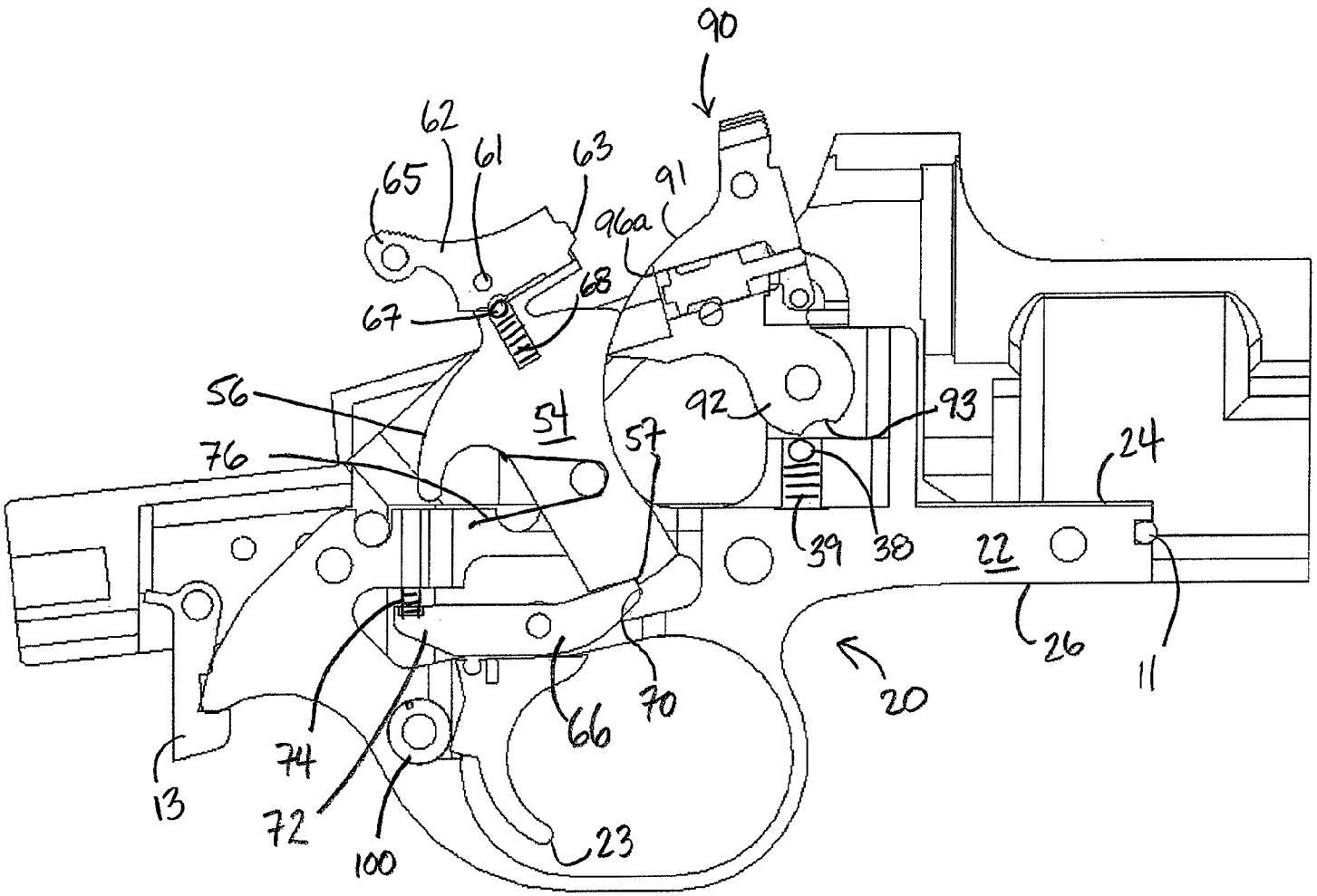
Figure 5:
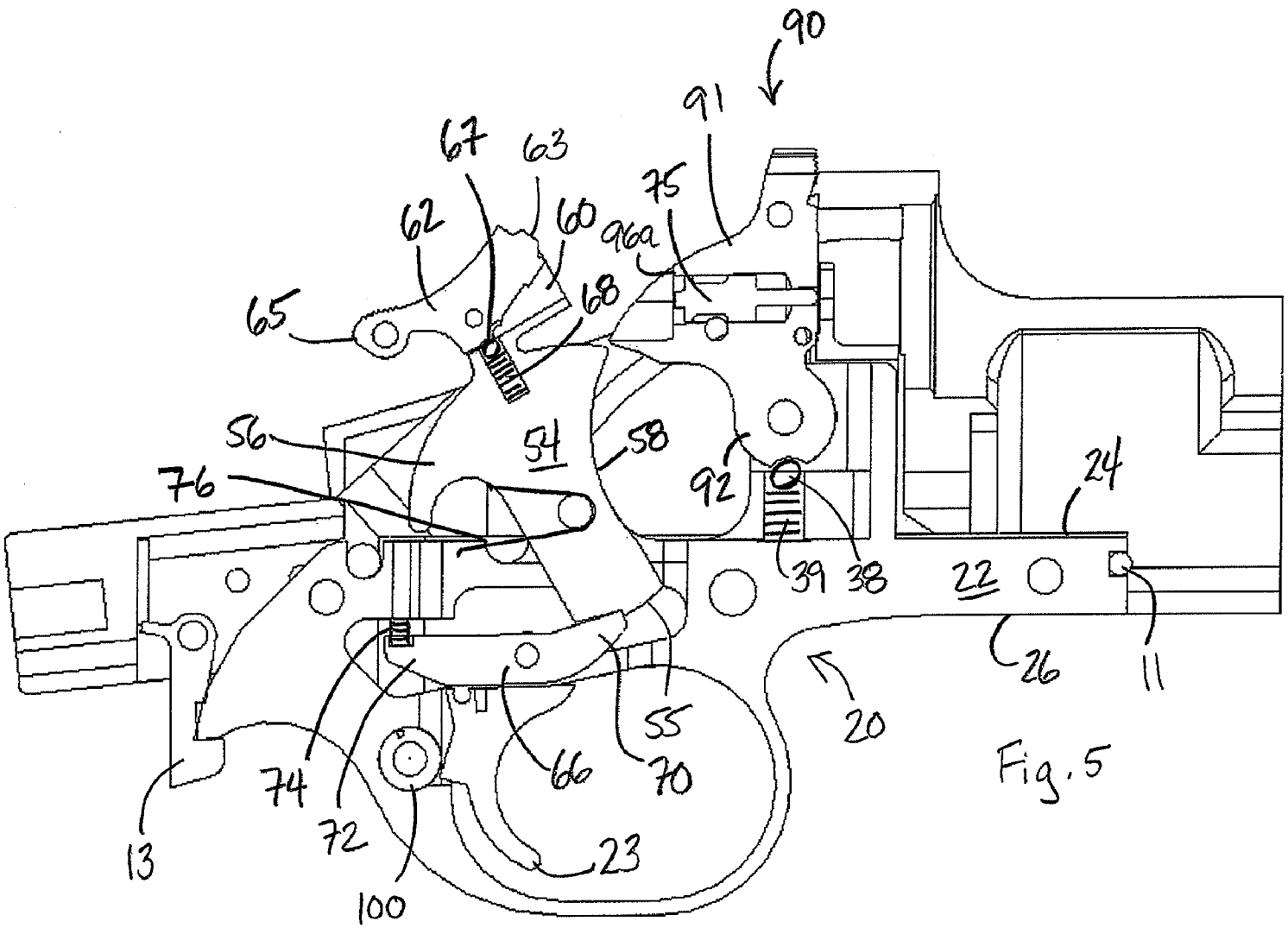
Figure 6:
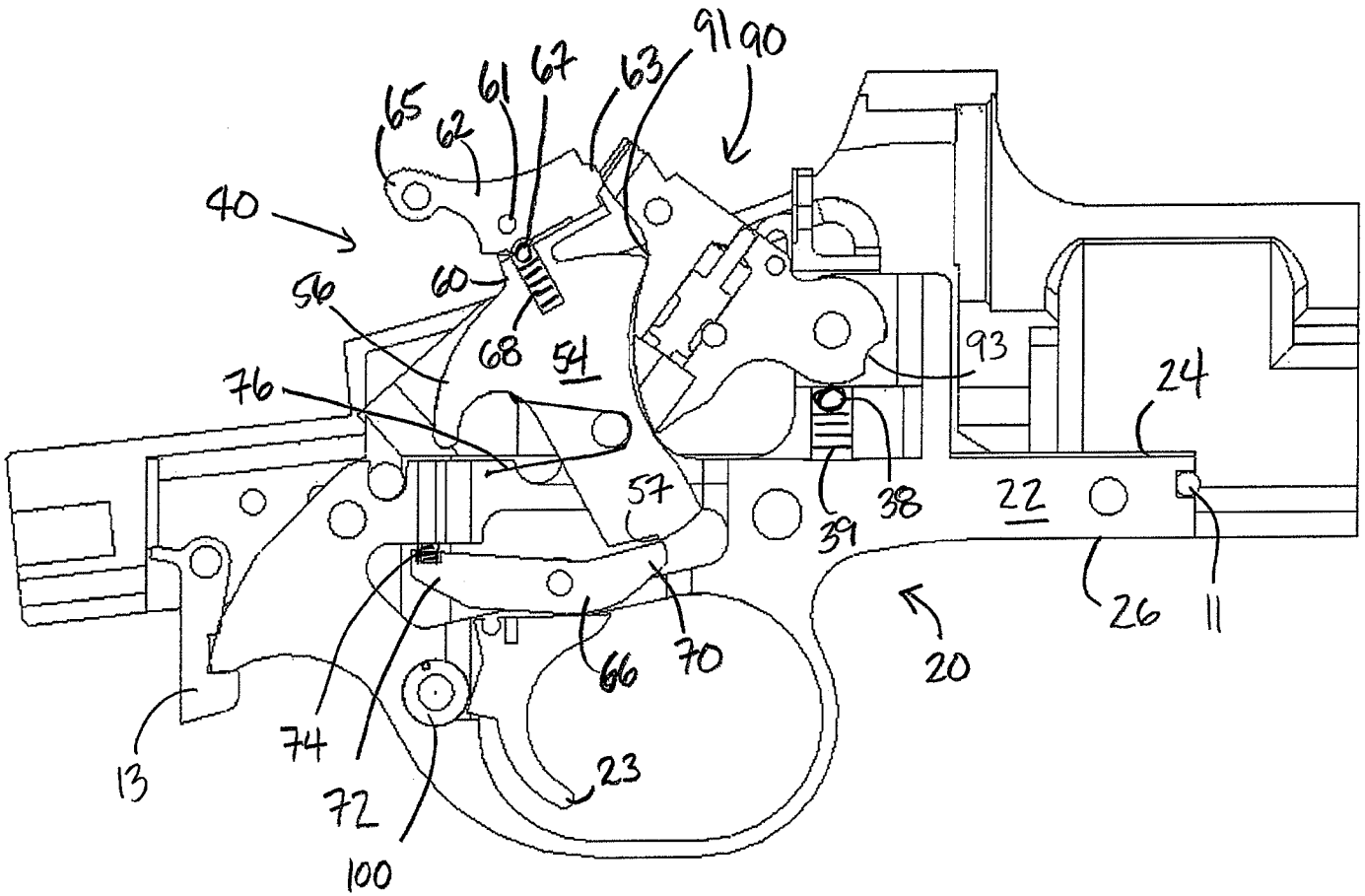

A muzzleloading rifle 10 as shown in FIG. 1 includes a front stock 12 and a rear stock 14, a forwardly extending barrel 16, a removable breech plug 18 in the rearward end of the barrel 16, and a trigger mechanism assembly 20. Looking to FIGS. 2-11, the trigger mechanism assembly 20 includes a trigger or base plate 22 that is held in place in the receiver with the assembly catch 13 and a pin 11 in the receiver. A rolling breechblock 90 and a hammer assembly 40 are also connected to the base plate 22 to assist the user in safely and effectively use the rifle 10, as described herein.

Figure 19:
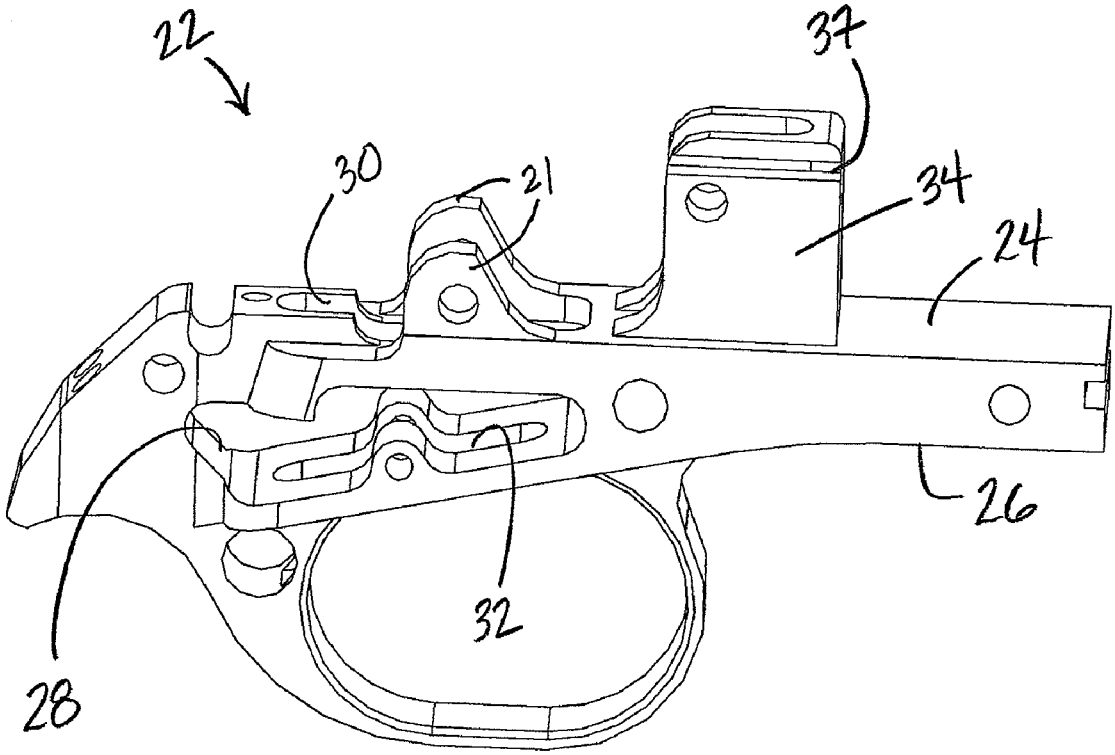
FIGS. 19 and 20 are top perspective views of the trigger plate illustrated in FIG. 18.
Figure 20:
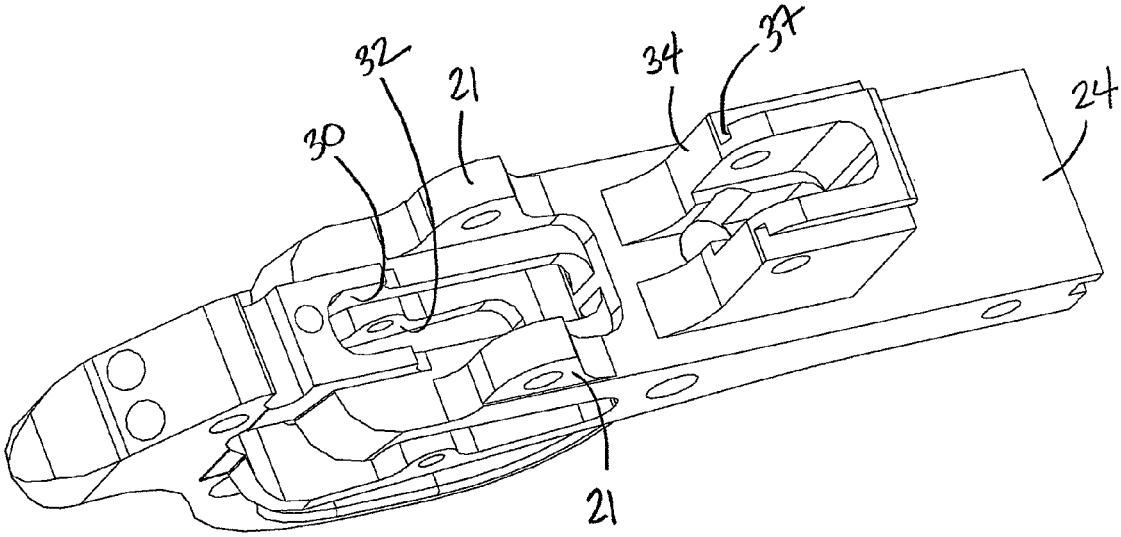
Figure 21:
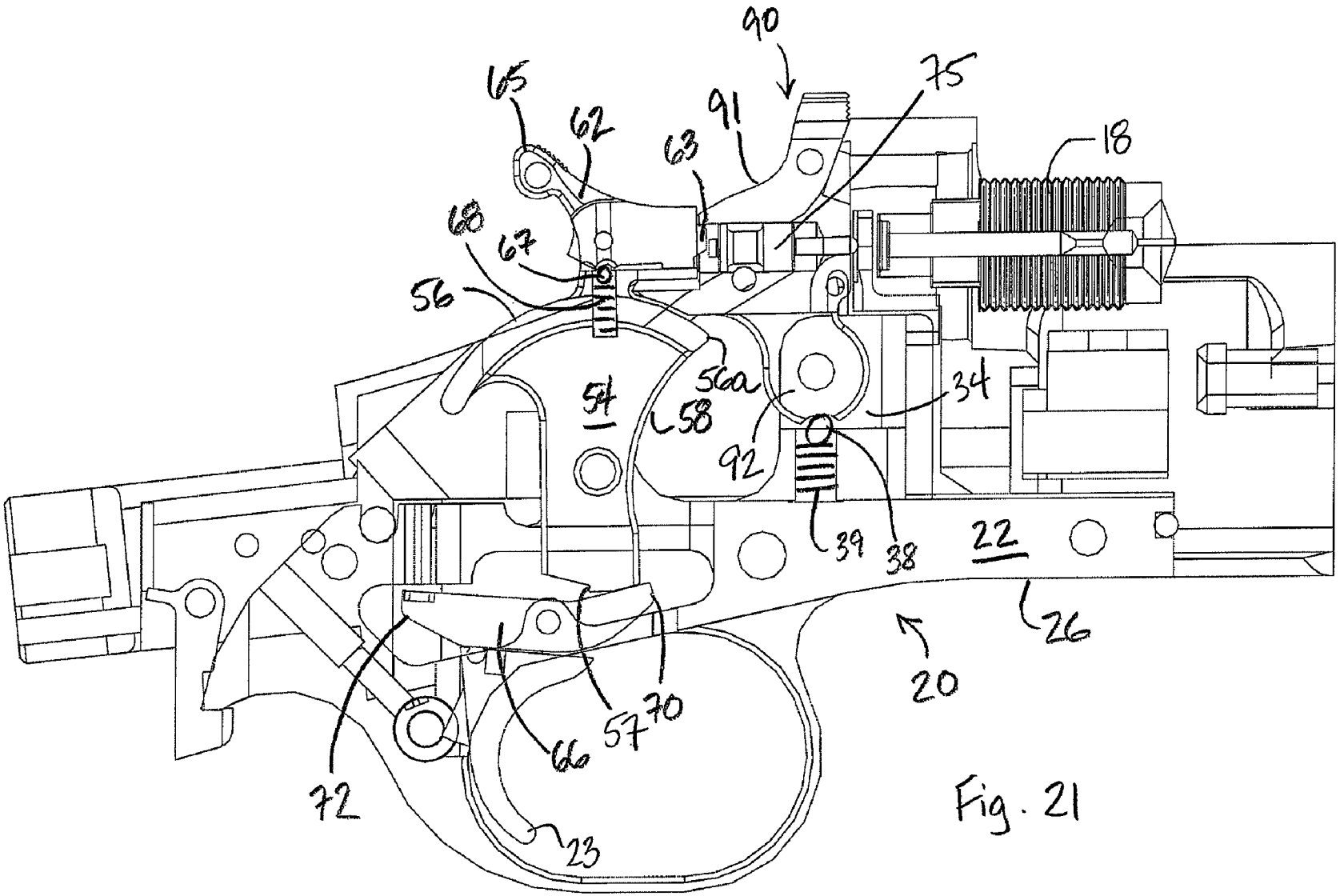
FIG. 21 is a side sectional view of the trigger assembly, hammer assembly, and rolling breechblock in the firearm.

Looking first to the trigger mechanism assembly 20, the trigger plate 22 includes an upper surface 24 and a lower surface 26, with a central cavity 28 traversing the trigger plate 22 between the upper surface 24 and the lower surface 26. Looking to FIGS. 19 and 20, an upper aperture 30 extends through the upper surface 24 of the trigger plate 22 into the central cavity 28, while a lower aperture 32 extends through the lower surface 26 of the trigger plate 22 into the central cavity 28. The trigger assembly 20 further includes a trigger 23 that is pivotally connected to a trigger pin 25 mounted in the central cavity 28, such that the trigger 23 is pivotable about the trigger pin 25.

A rolling block sear 66 is positioned in the central cavity 28 of the trigger plate 22. The trigger pin 25 extends through both the sear 66 and the trigger 23 to mechanically connect the trigger 23 and the hammer assembly 40. The sear 66 is a bar having a distal end 70 and a proximal end 72, with the sear 66 having at least one surface with a substantially arcuate or similar shape between the ends 70, 72. A sear cocking spring 74 is positioned between the proximal end 72 of the sear 66 and the upper surface of the central cavity 28, with the sear cocking spring 74 applying a force in direction A on the proximal end 72 of the sear 66 (see FIG. 2), forcing the proximal end 72 away from the upper surface of the central cavity 28. As discussed further herein, the distal end 70 of the sear 66 will be in continuous communication with the hammer assembly 40, with the sear 66 locking the hammer assembly 40 when the hammer assembly 40 is cocked into a loaded position for proper firing of the rifle 10 (as discussed further herein).

Figure 7:
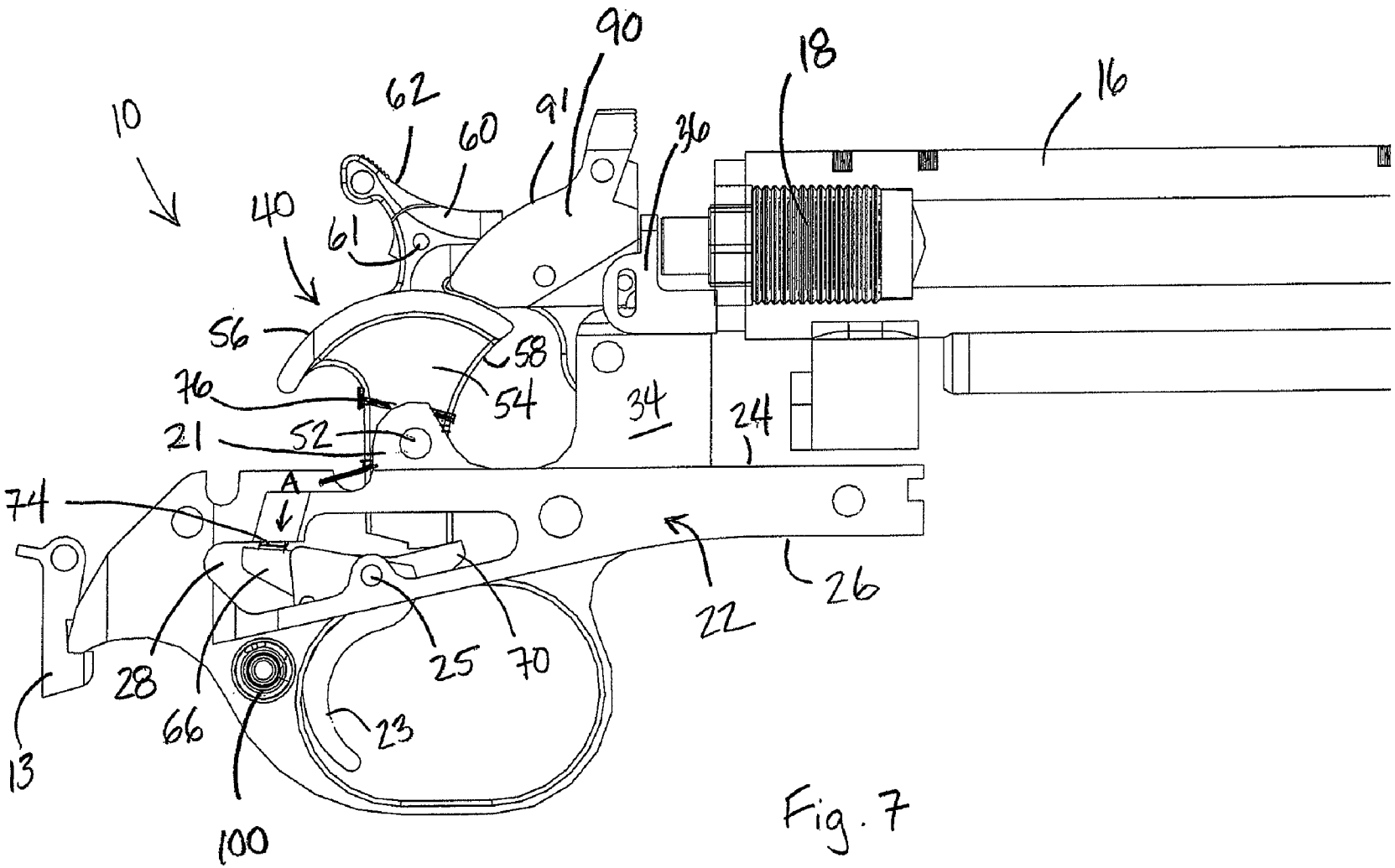
FIG. 7 is a side elevational views of the trigger assembly of the firearm illustrated in FIG. 1.
Figure 8:
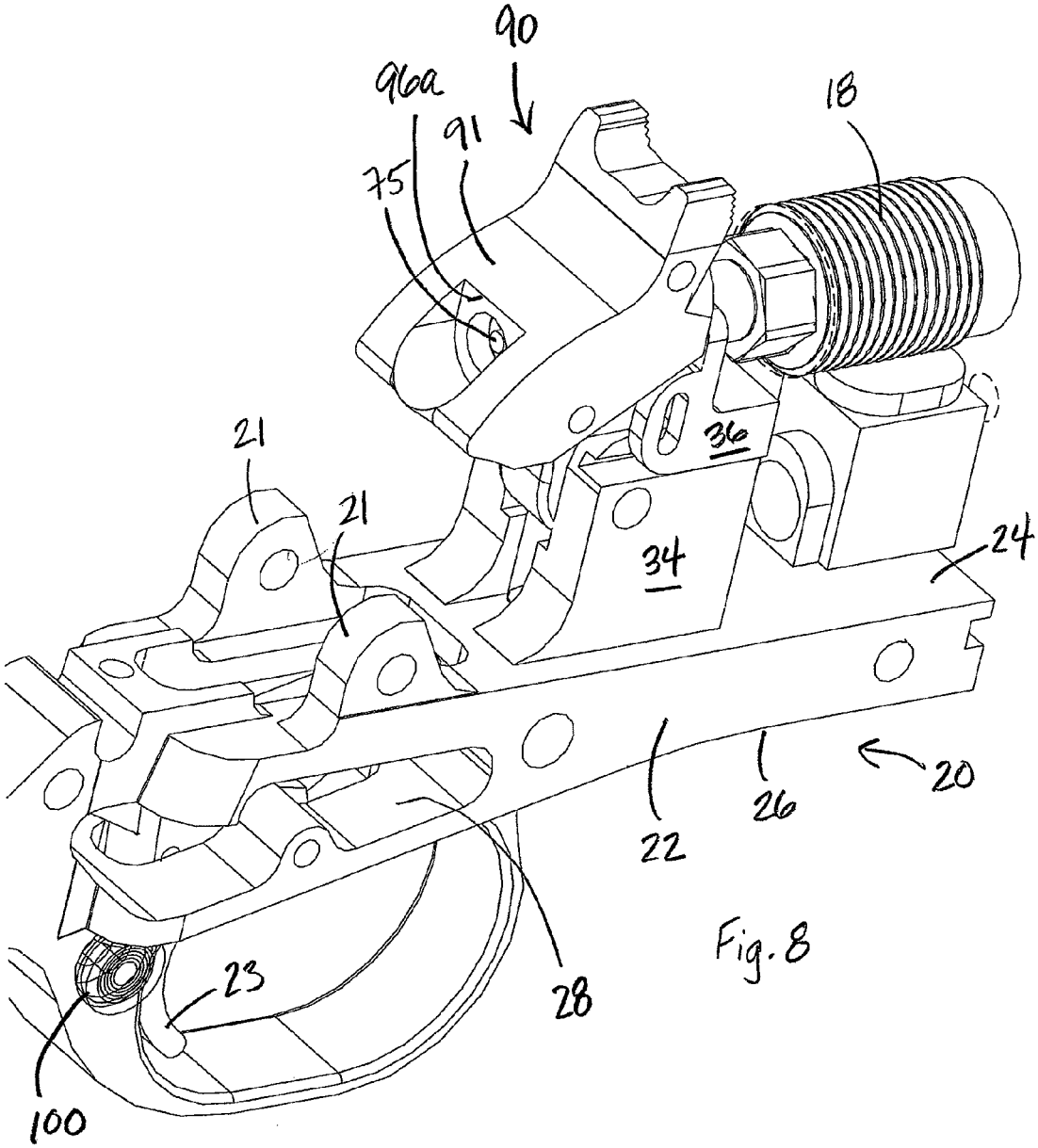
FIG. 8 is a rear perspective view of the trigger assembly and rolling breechblock.
Figure 9:
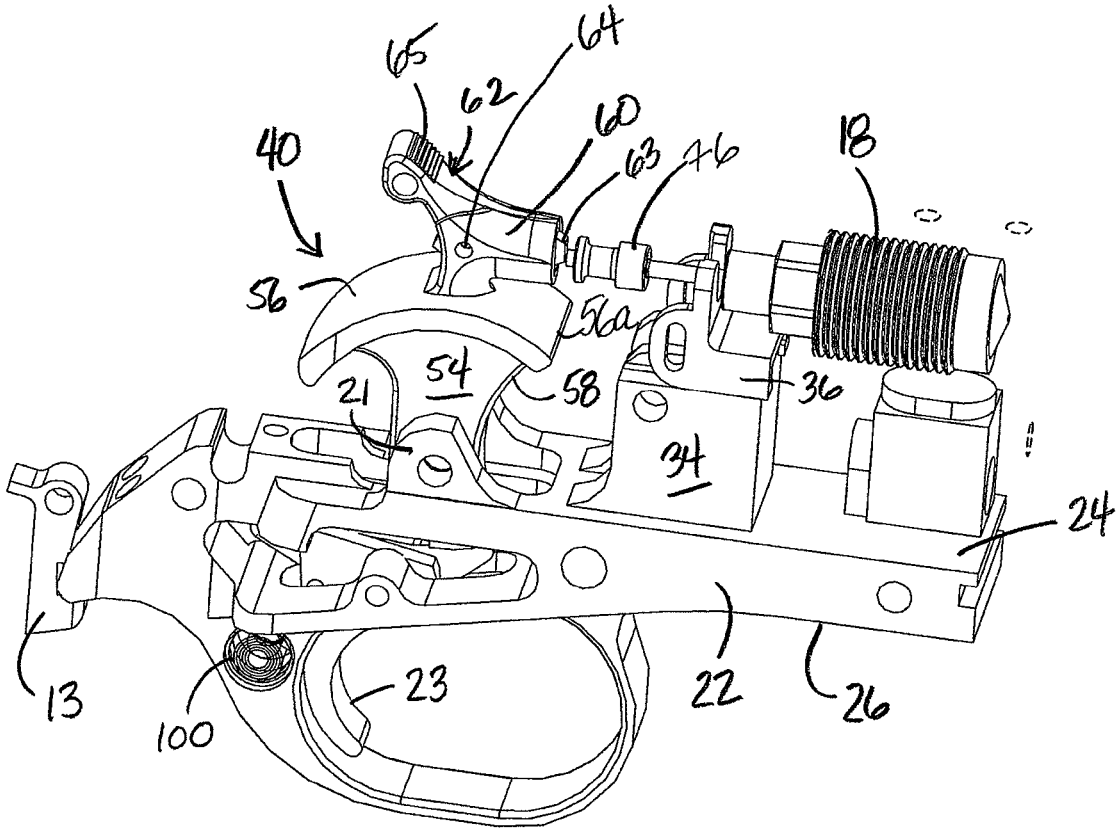
FIG. 9 is a side perspective view of the trigger assembly and hammer assembly.
Figure 10:
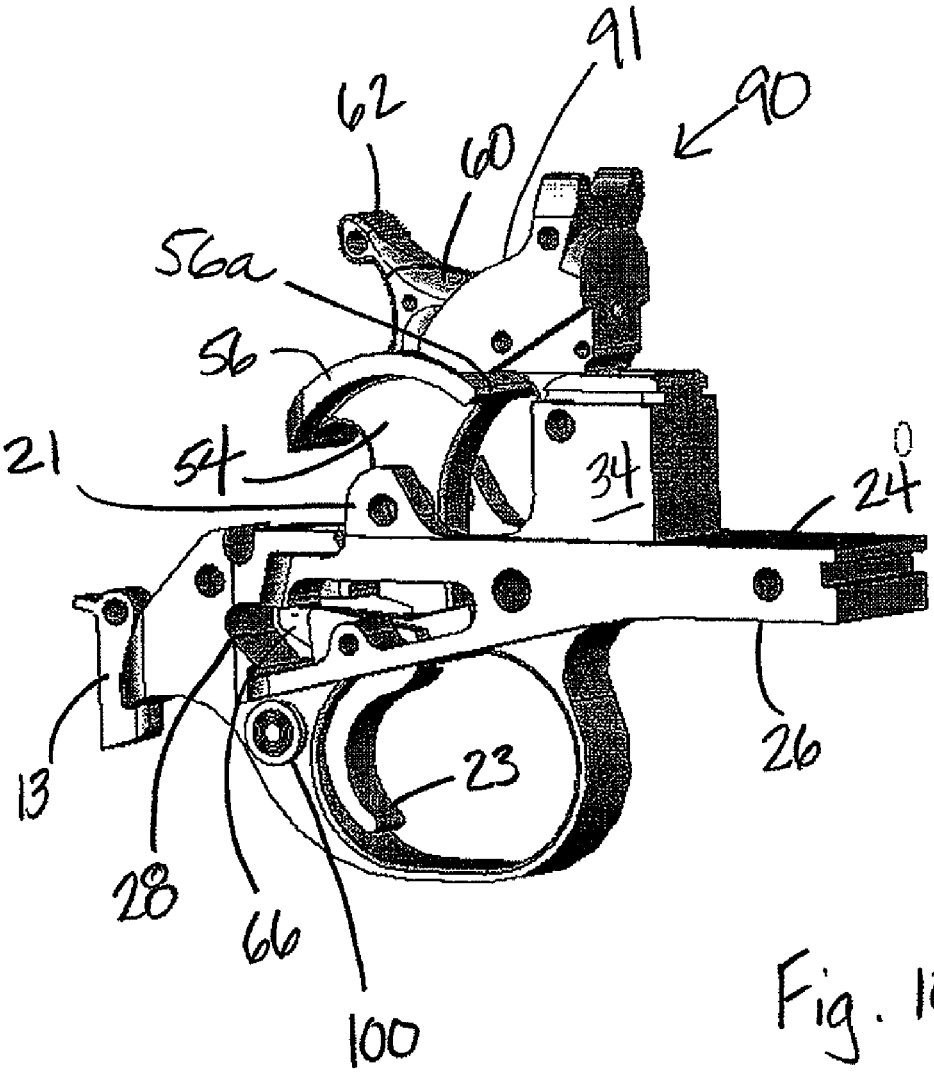
FIG. 10 is a front perspective view of the trigger assembly, hammer assembly and rolling breechblock.
Figure 11:
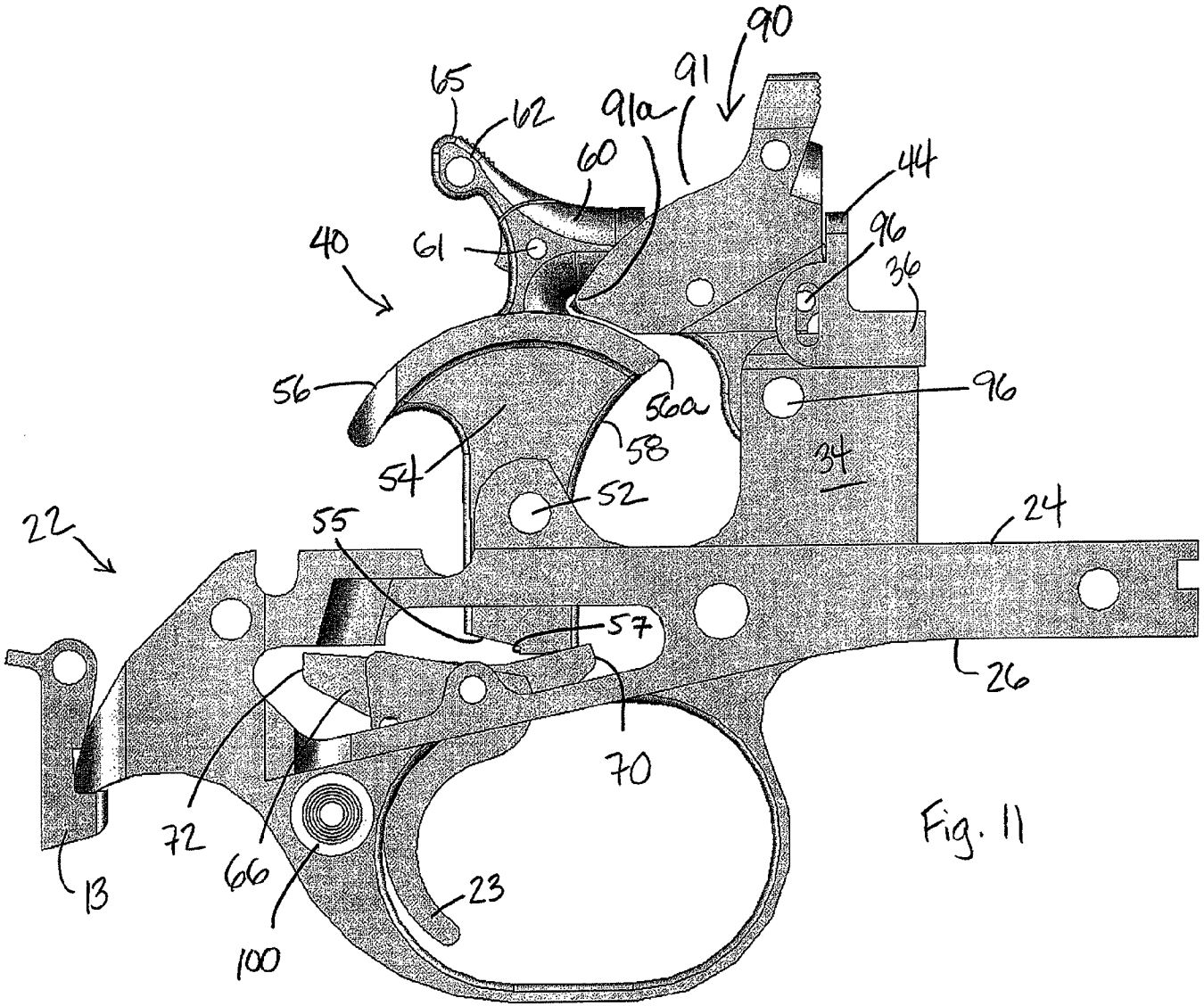
FIG. 11 is a side elevational view of assemblies illustrated in FIG. 10.
Figure 12:
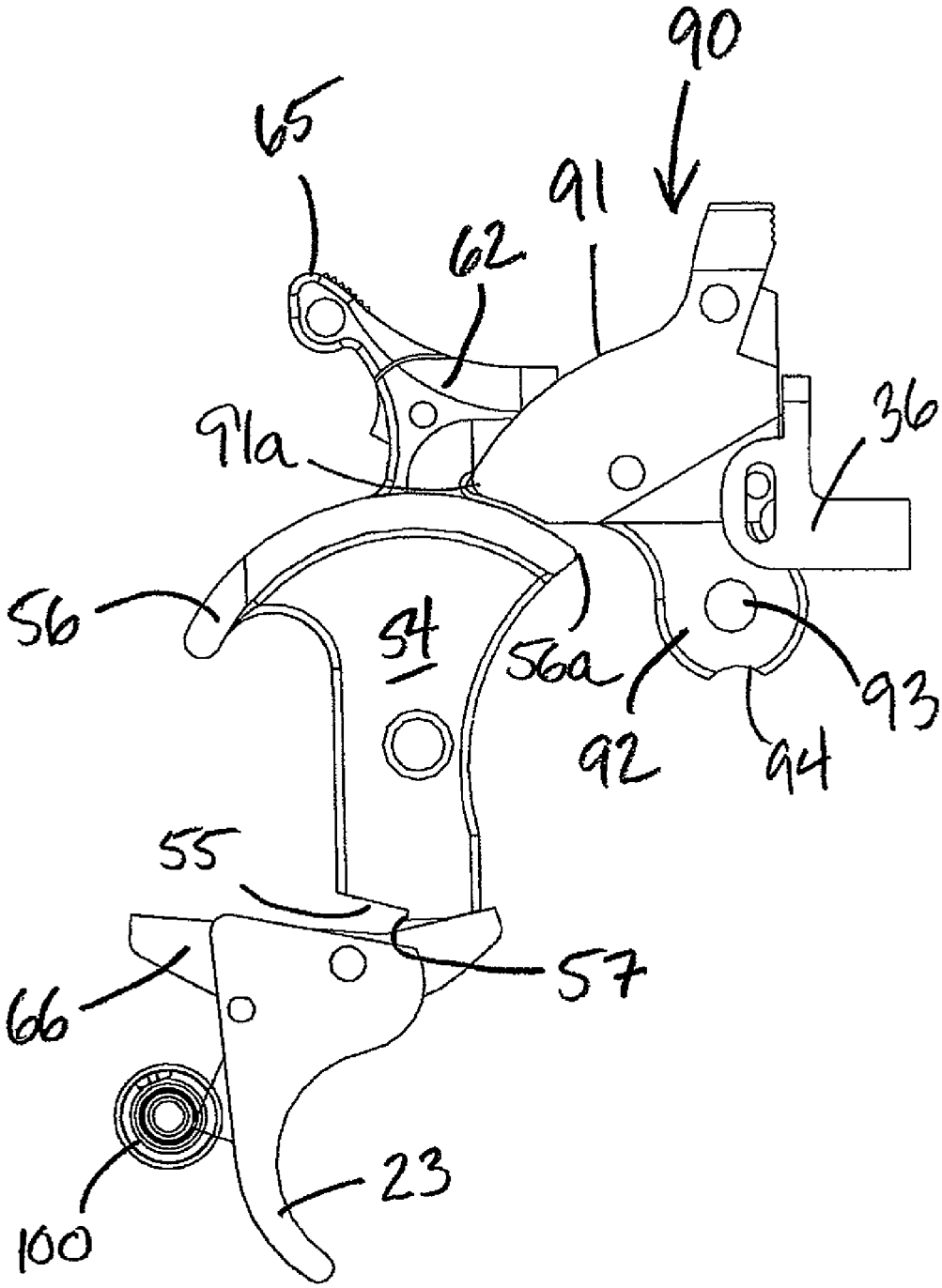
FIG. 12 is a side elevational view of the hammer assembly in relation to the rolling breechblock and trigger.
Figure 13:
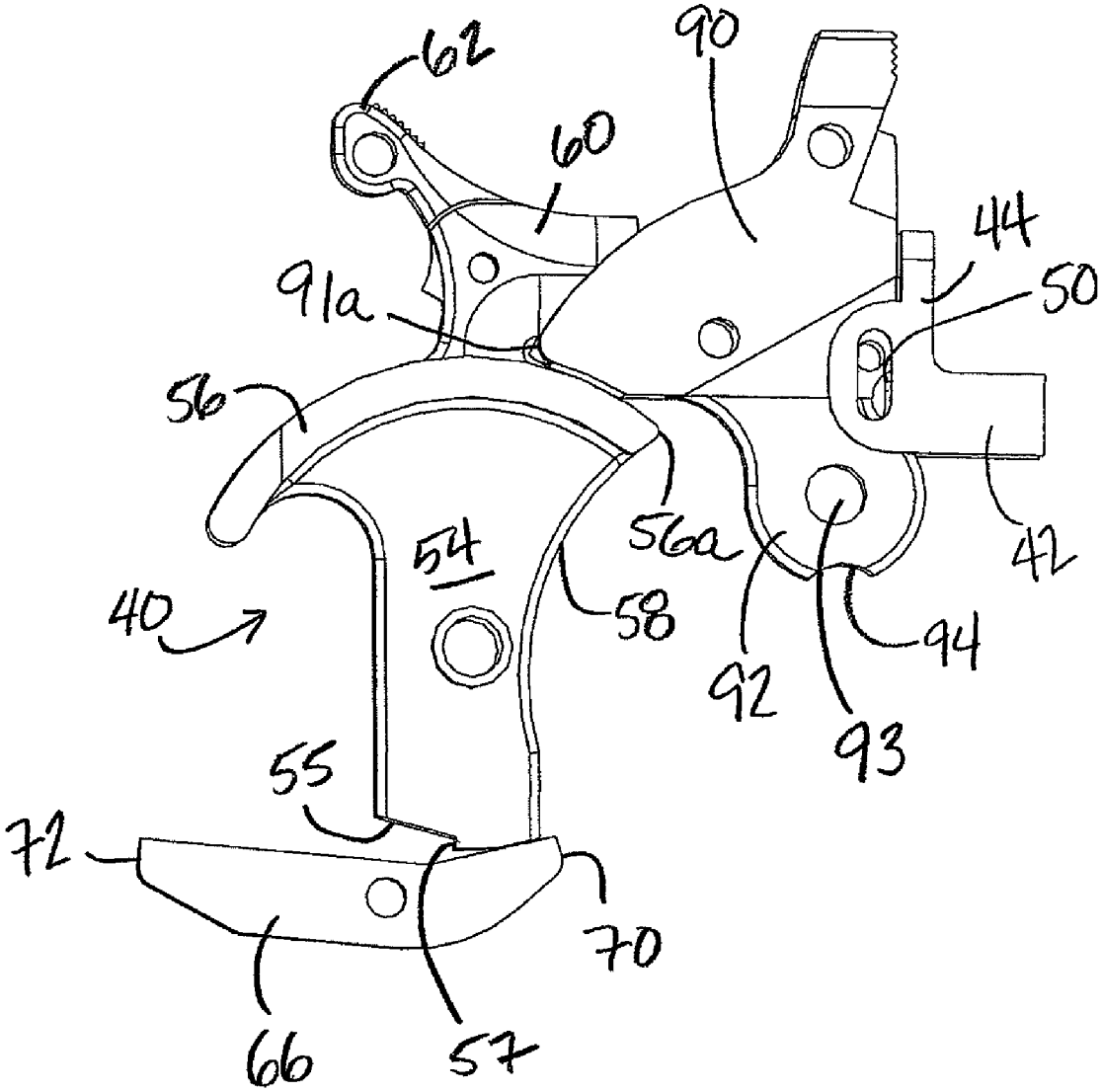
FIG. 13 is a side elevational view of the hammer assembly in relation to the rolling breechblock and sear.
Figure 14:
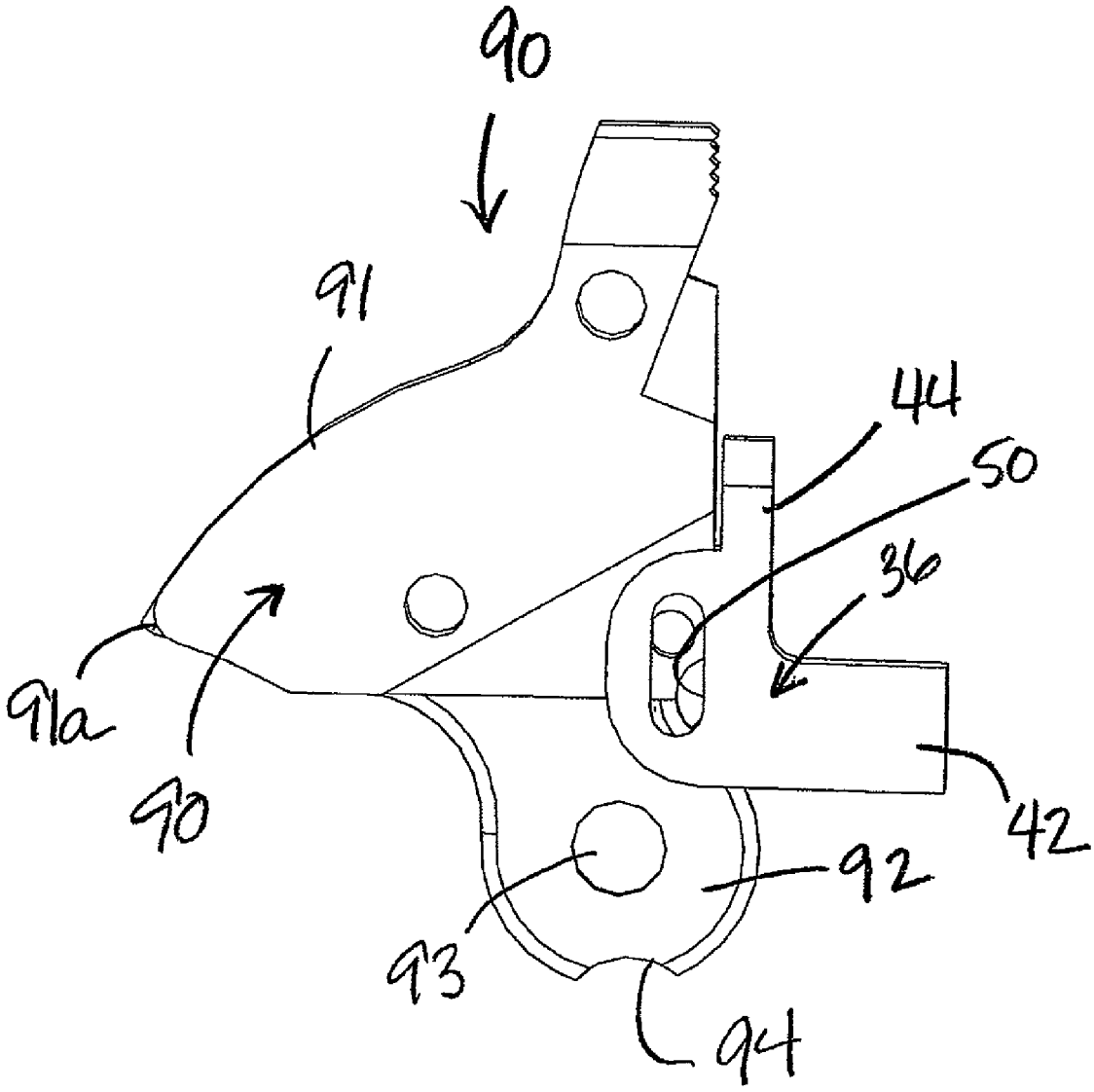
FIG. 14 is a side elevational view of the rolling breechblock.
Figure 15:
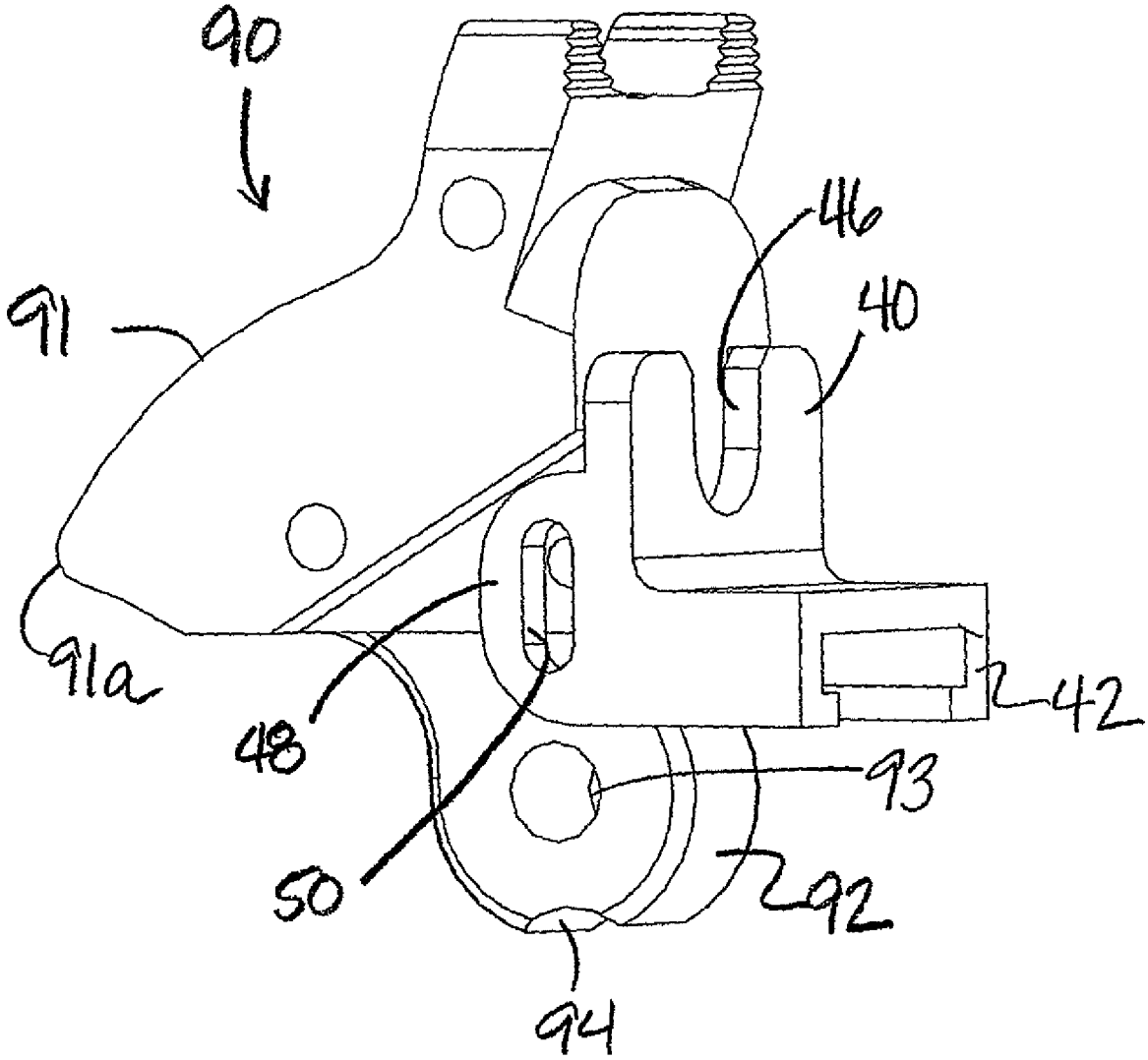
FIGS. 15-17 are front perspective views of the rolling breechblock illustrated in FIG. 14.
Figure 16:
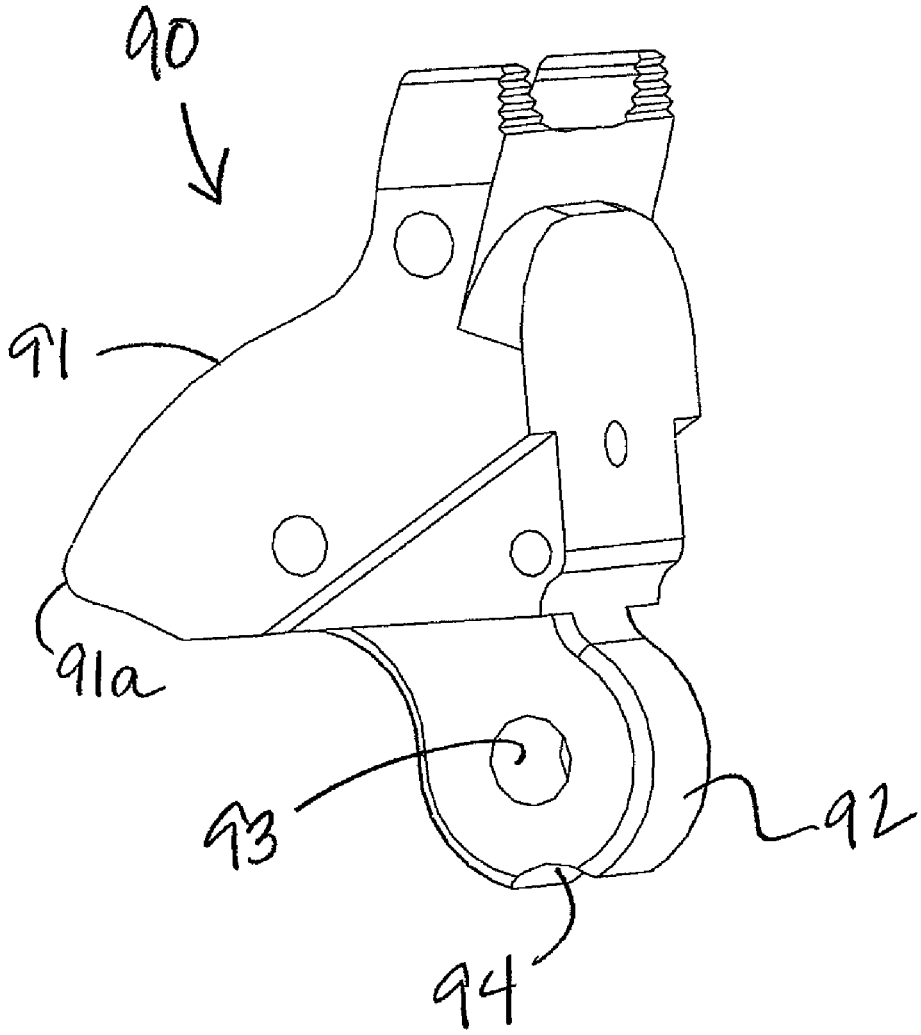
Figure 17:
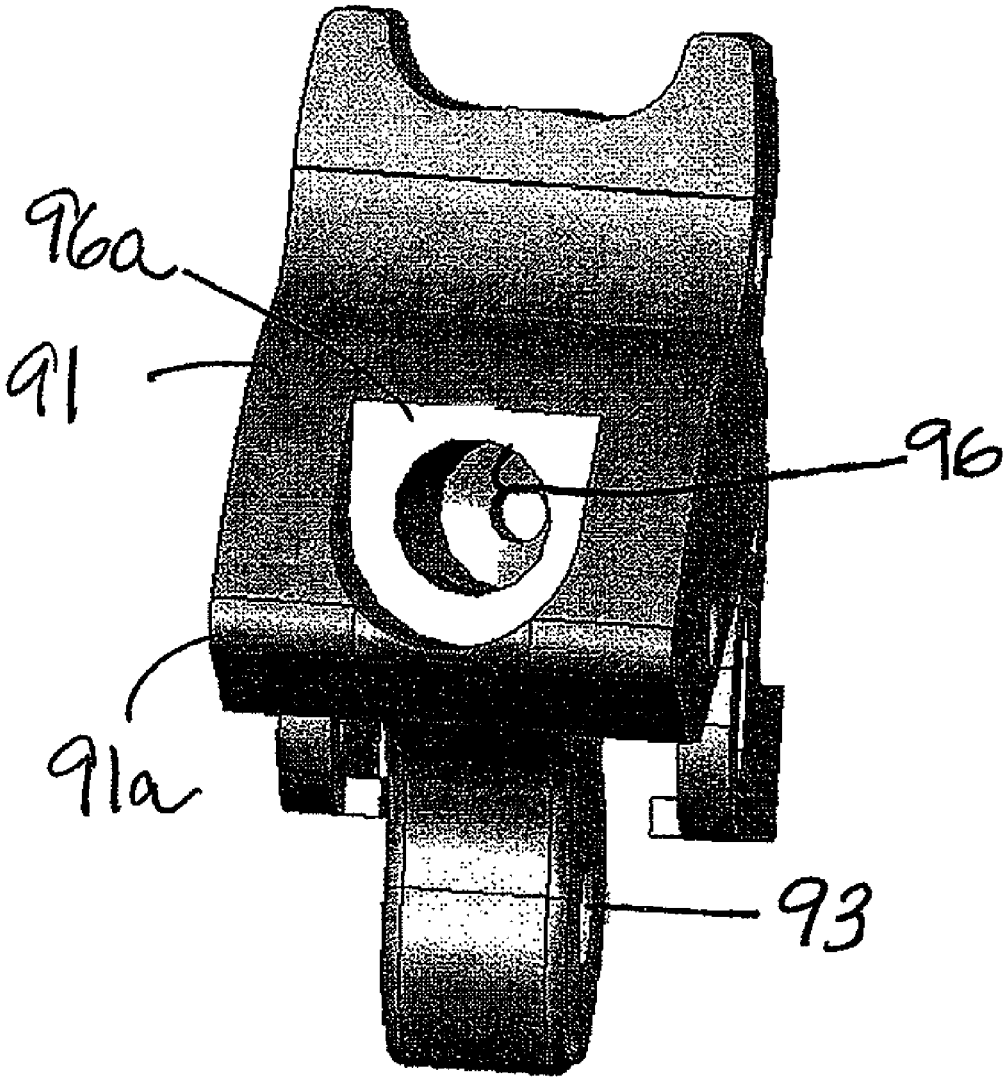
Figure 18:
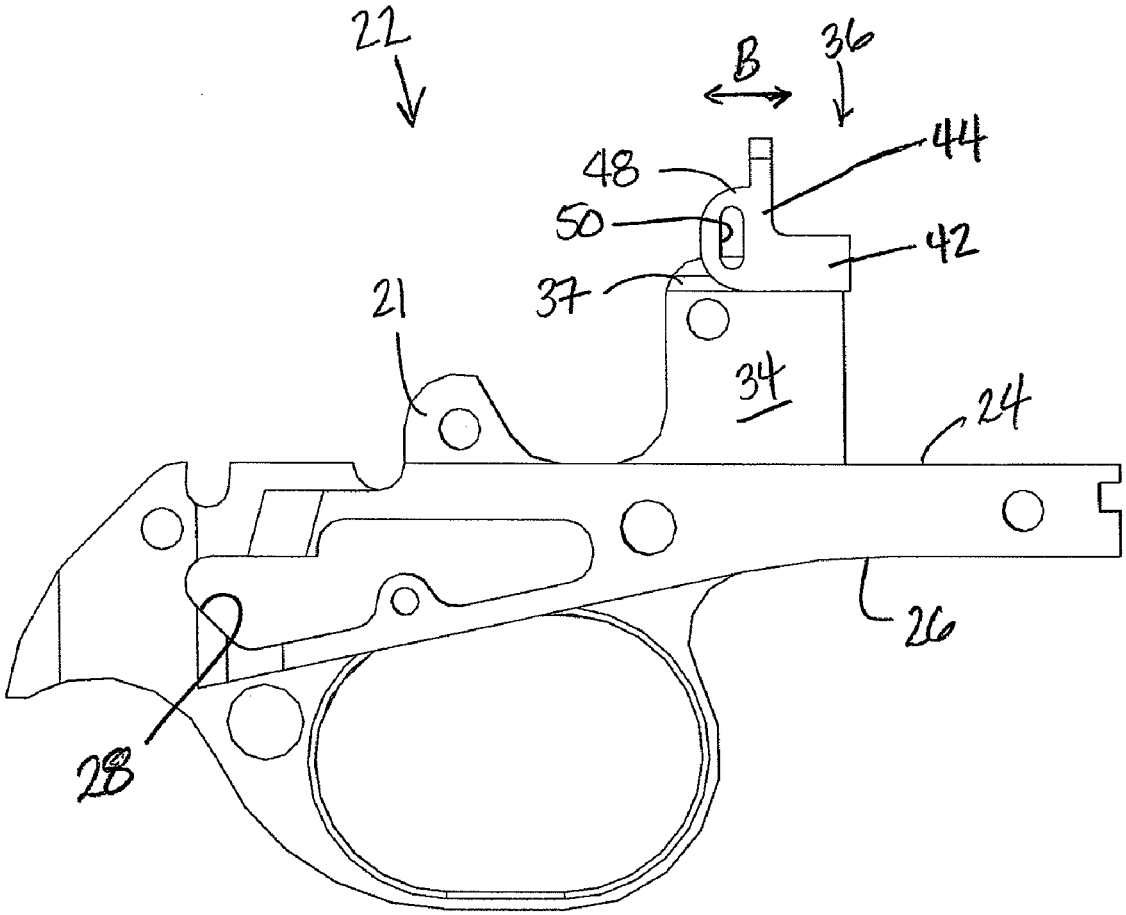
FIG. 18 is a side elevational view of the trigger plate.

Referring to FIG. 7, the trigger mechanism assembly 20 additionally includes a pair of parallel hammer mounting supports 21 that extend from the upper surface 24 of the trigger plate 22 on opposite sides of the upper aperture 30. The hammer assembly 40 is connected between the hammer mounting supports 21 via a hammer pin 52, such that the hammer assembly 40 will pivot about hammer pin 52. The hammer assembly 40, as shown in FIGS. 11 and 12, includes a base 54 that extends through the upper aperture 30 of the trigger plate 22, with the base 54 having an upper arcuate surface 56, a lower locking surface 55, and an interior arcuate surface 58 separating the upper arcuate surface 56 and the lower locking surface 55 having a locking shoulder 57. Affixed centrally to the upper arcuate surface 56 is a hammer head member 60, with a hammer safety 62 pivotally secured to the head member 60 via a safety connector or pin 61. The hammer safety 62 includes a spur 63 at a distal edge and a thumb engaging surface 65 at a substantially opposing proximal edge (see FIG. 9). A mainspring 76 is positioned about the base 54, with the mainspring 76 applying a continuous force on the base 54 to direct the spur 63 toward a primer when the rifle 10 is fired.

A rolling block support member 34 is affixed to the upper surface 24 of trigger plate 22 forward of the upper aperture 30 toward the barrel 16. The rolling breechblock 90 is connected to (see FIGS. 8 and 12-17). The support member 34 is used to support both an extractor 36 and the rolling breechblock 90 so that the user can easily load the primer for use with the rifle 10. More specifically, the extractor 36 slidingly engages grooves 37 in the upper surface of the support member 34, such that the extractor 36 will move toward and away from the barrel 16 and the breech plug 18 along the path B. The extractor 36 includes a pedestal 42 engaging the grooves 37 of the mounting block 34, and a back 44 attached to the pedestal 42 at a right angle. The back 44 has a centrally located substantially circular or oval-shaped notch 46 located along the upper surface of the back 44 to support a primer, and two parallel arms 48 extend along the back 44, each arm 48 having a rolling block engaging slot 50. Additionally, the support member 34 includes an aperture 35 that houses a breechblock bearing 38 and spring 39, with the breechblock bearing 38 positioned between rolling breechblock 90 and the spring 39. As a result, the spring 39 will apply a pressure on the breechblock bearing 38 so that the breechblock bearing 38 is in constant engagement with the rolling breechblock 90.

The rolling breechblock 90 is connected to the support member 34 to work in combination with the extractor 36. The rolling breechblock 90 includes an curved upper surface 91, with a firing pin bore 96 extending into the upper surface 91 to receive a firing pin 75. The firing pin bore 96 defines a locking edge 96*a* to be engaged by the hammer safety 62 as described herein. Substantially opposite the curved upper surface 91 is a substantially annular connector 92 having a connecting aperture 93 extending therethrough. A breechblock connecting pin 95 extends through the connecting aperture 93 to be joined with the support member 34, such that the rolling breechblock 90 will rotate about the breechblock connecting pin 95. A detent 94 is formed in the lowermost portion of the annular connector 92, and the detent 94 is engaged by the breechblock bearing 38. As a result, the bearing 38 will apply a marginal force on the detent 94 to prevent undesired rotation of the rolling breechblock 95. In addition, an extractor pin 97 extends transversely trough the rolling breechblock 90 and into each rolling block engaging slot 50, thereby mechanically connecting the rolling breechblock 90 with the extractor 36.

In operation, the user will move the trigger assembly 40 into a retracted, cocked position by engaging and applying pressure to the thumb engaging surface 65 of the hammer assembly 40. The hammer head member 60 will pivot about hammer pin 52, against the force of mainspring 76, from a resting position to the cocked position. As the body 54 is rotated about the hammer pin 52, the lower locking surface 55 of the body 54 will slide across the sear 66 until the locking shoulder 57 of the lower locking surface 55 extends beyond the distal edge 70 of the sear 66. At that point, the sear cocking spring 74 will force the distal edge 70 into a wedged position with the locking shoulder 57 so that the hammer assembly 40 is in the cocked position.

In the cocked position, the rolling breechblock 90 will then be able to pivot from an upright position toward the upper surface 24 of the trigger plate 22. As the rolling breechblock 90 is drawn toward the trigger plate 22, the extractor pin 96 in the slot 50 will concomitantly draw the extractor 36 in a direction toward the hammer assembly 40 and away from the breech plug 16. The user will then be able to remove a spent primer (if present) and place a new primer (not illustrated) in the notch 46. The user will then move the breechblock 90 in an opposite direction, locking the primer in the notch 46 of the extractor 36 and proximate the rolling breechblock 90 and firing pin 75, such that the firearm is ready to be fired. When the trigger 23 is pulled, the proximal end 72 of the sear 66 will move against the sear cocking spring 74, such that the distal end 70 of the sear 66 will disengage its contact against the shoulder 57 of the hammer assembly 40, thereby releasing the hammer assembly 40. The force applied by the mainspring 76 will cause the hammer assembly 40, and in particular, the hammer head member 60, to move rapidly toward the rolling breechblock 90, and the spur 63 on the hammer safety 62 engages the firing pin 75 to fire the rifle 10.

While this operation is desirable, it is the case that as the primer is being loaded, the trigger 23 may be inadvertently pulled by the user, thereby dislodging the distal edge 70 of the sear 66 from the locking shoulder 57 of the hammer assembly 40. Although the movement of the sear 66 will not cause the rifle 10 to fire since the firing pin 75 is not in line with the spur 63, it could also prevent the rifle 10 from being fired once the rolling breechblock 90 has been moved into the loaded position since the sear 66 would not be engaging the locking shoulder 57. To solve this problem, the rolling breechblock 90 has been positioned on the mounting block 34 with respect to the hammer assembly 40 such that a proximal edge 91*a* of the rolling breechblock 90 will contact the arcuate surface 56 of the hammer assembly 40 up to a distal edge 56*a* of the arcuate surface 56. Specifically, when the rolling breechblock 90 is positioned to remove and replace the primer, the hammer assembly 40 is required to be drawn away from the rolling breechblock 90 by the user applying pressure to the thumb engaging surface 65 of the hammer assembly 40 (see FIGS. 3 and 4). Thus, if the sear 66 is displaced from its locking engagement with the shoulder 57, as the rolling breechblock 90 is returned to the operating position, the curved surface 91 will engage the distal edge 56*a* of the upper arcuate surface 56 of the hammer assembly 40. The curved surface 91 of the rolling breechblock 90 is designed to apply a force on the distal edge 56*a* of the upper arcuate surface 56 against the mainspring 74. This force causes the lower locking surface 55 of the hammer assembly 40 to move along the sear 66 toward the distal end 70 of the sear 66. At the point that the proximal edge 91*a* and the distal edge 56*a* contact, the lower locking surface 55 will have moved along the sear 66 such that the distal end 70 of the sear 66 will once again engage the shoulder 57.

To further assist in the safe operation of the rifle 10, a primary safety 100 is included in trigger base 22 proximate the trigger 23. The primary safety 100 may be moved between a locked and unlocked position, such that in the locked position, the user will not be able to move the trigger 23 to fire the rifle 10, but in the unlocked position, the trigger 23 may be pivoted freely to fire the rifle 10.

In addition, as noted above, the hammer safety 62 of the hammer assembly 40 is pivotal about the safety pin 61 to move between a first firing pin engaging position (see FIG. 2) and a second locked rolling block engaging position (see FIG. 5) to prevent unintentional firing of the rifle 10. That is, in the first firing pin engaging position, the spur 63 of the hammer safety 22 will engage a firing pin 75 in the rolling breechblock 90. In contrast, in the second safety locked rolling block engaging position, the spur 63 will jam against the locking edge 96*a* of the firing pin bore 96 in the rolling breechblock 90. Thus, the hammer safety 62 acts to prevent an undesired firing of the firearm after the user has replaced a primer.

Further, it is to be noted that a safety bearing 67 and a safety spring 68 are housed in the base 54 proximate the hammer safety 62. The safety spring 68 provides a consistent force on the safety bearing 67 to force engagement with the hammer safety 62, such that a force on the thumb engaging surface 65 is required by the user to pivot the hammer safety 62 about the pin 61. Thus, the rifle 10 has a smooth, reliable hammer assembly 40 with integrated hammer safety 62 to provide two safeties.

In operation, the user will pull the trigger 23 to release the hammer assembly 40, with the hammer head member 62 striking the firing pin 75 to engage the primer and ignite it. The flame from the primer travels through the hollow nipple to ignite the main powder charge. Once the primer is spent, it is to be replaced as described above.

Having thus described exemplary embodiments of a MUZZLELOADING RIFLE WITH ROLLING BLOCK

TRIGGER ASSEMBLY, it should be noted by those skilled in the art that the within disclosures are exemplary only and that various other alternatives, adaptations, and modifications may be made within the scope of the present invention. Accordingly, the invention is not limited to the specific embodiments as illustrated herein, but is only limited by the following claims.

What is claimed is:

1. A muzzleloading firearm for engaging a firing pin to discharge a primer, the firearm comprising:

a trigger mechanism assembly connected between a front stock and a rear stock, the trigger mechanism assembly including a trigger plate having an upper surface and a lower surface, with a central cavity traversing the trigger plate between the upper and lower surfaces;

a sear having a distal end and a proximal end, the sear positioned in the central cavity;

a trigger in mechanical communication with the sear;

a hammer assembly pivotally mounted to the trigger plate to rotate between a cocked position and a resting position, the hammer assembly comprising:

a base extending into the central cavity through the upper surface, the base including an upper arcuate surface with a distal edge, a lower locking surface opposite the upper arcuate surface defining a shoulder, and an interior arcuate surface between the upper arcuate surface and the lower locking surface, and a head member connected to the upper arcuate surface of the base;

a support member connected to the trigger plate forward of the hammer assembly, the support member having two grooves;

an extractor slidably connected to the grooves of the support member; and a rolling breechblock connected to the support member and the extractor, the rolling breechblock pivotal between a retracted loading position and a firing position, wherein the rolling breechblock comprises a connector affixed with the support member and a curved upper surface opposite the connector, the curved upper surface engaging the distal edge of the upper arcuate surface of the hammer assembly when moving between the loading position and the firing position to force the distal end of the sear to engage shoulder of the base.

2. The firearm as described in claim 1 further comprising a hammer safety pivotally connected to the hammer head member to move between a hammer firing position and a hammer safety position.

3. The firearm as described in claim 2 further comprising:

a spring positioned in the hammer base proximate the hammer safety; and a ball positioned between the spring and the hammer safety, the spring forcing the ball into contact with the hammer safety;

wherein the hammer safety includes a detent proximate the ball to limit pivotal movement of the hammer safety about the hammer head member.

4. The firearm as described in claim 2, wherein said sear has at least one arcuate surface between the distal end and the proximal end.

5. A firing mechanism for a muzzleloading rifle having a front stock, a rear stock, a rifle barrel with a forward and rearward end, a breech plug in the rearward end of the barrel, the firing mechanism comprising:

a trigger plate mechanism assembly connected between the front stock and the rear stock, the trigger mechanism assembly including a trigger plate having an upper surface and a lower surface, with a central cavity traversing the trigger plate between the upper and lower surfaces;

an arcuate sear having a distal end and a proximal end, the sear positioned in the central cavity; and a trigger in mechanical communication with the sear;

a hammer assembly pivotally mounted to the trigger plate to rotate between a cocked position and a resting position, the hammer assembly comprising:

a base extending into the central cavity through the upper surface, the base including an upper arcuate surface, a lower surface opposite the upper arcuate surface defining a shoulder, and an interior arcuate surface between the upper arcuate surface and the lower surface, a head member connected to the upper arcuate surface, and a hammer safety pivotally connected to the head member to move between a hammer firing position and a hammer safety position; and a support member connected to the trigger plate forward of the hammer assembly, the support member having two grooves;

an extractor slidably connected to the grooves of the support member; and a rolling breechblock connected to the support member and the extractor, the rolling breechblock pivotal between a retracted loading position and a firing position, the rolling breechblock comprising a connector affixed with the support member and a curved upper surface opposite the connector, the curved upper surface engaging the interior arcuate surface of the hammer assembly when moving between the loading position and the firing position to force the distal end of the sear to engage shoulder of the base.

* * * * *